US009583852B1

(12) United States Patent
Folker et al.

(10) Patent No.: US 9,583,852 B1
(45) Date of Patent: Feb. 28, 2017

(54) PCB HOLDER HAVING A LEG WITH A PASSAGEWAY WITH A CONDUCTIVE PIN THEREIN TO ELECTRICALLY CONNECT TWO PCBS

(71) Applicant: Universal Lighting Technologies, Inc., Madison, AL (US)

(72) Inventors: Donald Folker, Madison, AL (US); John J. Dernovsek, Madison, AL (US); Mike LeBlanc, Huntsville, AL (US)

(73) Assignee: UNIVERSAL LIGHTING TECHNOLOGIES, INC., Madison, AL (US)

( * ) Notice: Subject to any disclaimer, the term of this patent is extended or adjusted under 35 U.S.C. 154(b) by 0 days.

(21) Appl. No.: 14/929,898

(22) Filed: Nov. 2, 2015

Related U.S. Application Data

(60) Provisional application No. 62/074,740, filed on Nov. 4, 2014.

(51) Int. Cl.

| | |
|---|---|
| ***H01R 12/00*** | (2006.01) |
| ***H01R 12/70*** | (2011.01) |
| ***H01R 43/20*** | (2006.01) |
| ***H01R 12/52*** | (2011.01) |

(52) U.S. Cl.
CPC ..... *H01R 12/7076* (2013.01); *H01R 12/523* (2013.01); *H01R 43/205* (2013.01)

(58) Field of Classification Search
CPC ..... H01R 9/096; H01R 12/57; H01R 13/41; H01R 23/6886; H01R 23/7073; H01R 23/772; H01R 23/725; H01R 23/2435; H01R 23/722; H01R 12/52
USPC ..... 439/65, 66, 69, 74
See application file for complete search history.

(56) References Cited

U.S. PATENT DOCUMENTS

| | | | | |
|---|---|---|---|---|
| 5,429,521 | A * | 7/1995 | Morlion | H01R 13/65802 439/108 |
| 5,991,165 | A * | 11/1999 | Jones, Jr. | H05K 9/0022 206/719 |
| 6,176,734 | B1 * | 1/2001 | Juntwait | H01R 23/661 439/493 |
| 6,549,428 | B1 * | 4/2003 | Fontana | H02B 1/20 174/71 B |
| 7,748,992 | B1 * | 7/2010 | Wooley | G06F 13/409 439/660 |
| 8,498,124 | B1 * | 7/2013 | Folker | H05K 1/145 361/740 |
| 2007/0117417 | A1 * | 5/2007 | O'Brien | H05K 1/142 439/65 |

(Continued)

*Primary Examiner* — Chandrika Prasad
(74) *Attorney, Agent, or Firm* — Patterson Intellectual Property Law, PC; Mark J. Patterson; Jerry Turner Sewell

(57) ABSTRACT

A horizontal printed circuit board (PCB) holder for connection to a first PCB and a second PCB may include a frame having one or more legs extending outwardly from the frame, each of the one or more legs having a passageway therein, and at least one conductive pin fixedly secured within the passageway of at least one of the one or more legs. The at least one conductive pin may convey electrical signals between the first PCB and the second PCB. A PCB holder assembly may include first and second PCBs connected to a PCB holder. A method of providing a PCB holder may include determining at least one characteristic of a first PCB and second PCB, configuring the PCB holder according to the determined characteristic(s), and connecting the first and second PCBs to the PCB holder.

20 Claims, 5 Drawing Sheets

(56) References Cited

U.S. PATENT DOCUMENTS

2013/0258631 A1 10/2013 Carter
2015/0118871 A1* 4/2015 Yagi ..... H01R 12/523
439/65

* cited by examiner

PCB HOLDER HAVING A LEG WITH A PASSAGEWAY WITH A CONDUCTIVE PIN THEREIN TO ELECTRICALLY CONNECT TWO PCBS

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

This application claims benefit of the following patent application which is hereby incorporated by reference in its entirety: U.S. Provisional Patent Application No. 62/074,740, filed Nov. 4, 2014, entitled "Apparatus and Method for Horizontally Connecting Printed Circuit Boards."

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to apparatuses and methods for horizontally connecting printed circuit boards. Conventional daughter boards are connected to a motherboard in a perpendicular (i.e., vertical) configuration. However, such a configuration limits the size, shape, expansion capabilities, power density, and overall attributes of the motherboard, the daughter board, and any corresponding structure or enclosure. For example, under a conventional configuration, it may be difficult or impossible to provide adequate shielding between the daughter board and motherboard, to provide a grounding layer, or to conform to physical space or power density requirements.

A need exists to provide a low cost method of forming an electrical connection between a printed circuit board and a second printed circuit board located in parallel to one another. A further need exists to provide a method for placing an electrical circuit on a printed circuit board horizontally (e.g., parallel to) above a second printed circuit board to increase the power density of the assembly. An additional need exists for providing a method for placing a shield or ground plane on a printed circuit board placed horizontally above a second printed circuit board. A need also exists for providing a method for placing lands and runs on a small printed circuit board placed horizontally above a second printed circuit board to be used as jumpers on the second printed circuit board.

BRIEF SUMMARY OF THE INVENTION

One embodiment of the present invention provides a horizontal printed circuit board (PCB) holder for connection to a first PCB and a second PCB. The PCB holder may include a frame having one or more legs extending outwardly from the frame, each of the one or more legs having a passageway therein, and at least one conductive pin fixedly secured within the passageway of at least one of the one or more legs. The at least one conductive pin may be configured to convey electrical signals between the first PCB and the second PCB when both of the first PCB and second PCB are connected to the PCB holder.

Another embodiment of the present invention provides a horizontal printed circuit board (PCB) holder assembly. The PCB holder assembly may include a first PCB, a second PCB, and a PCB holder. The PCB holder may comprise a frame having one or more legs extending outwardly from the frame, each of the one or more legs including a passageway therein, and at least one conductive pin fixedly secured within the passageway of at least one of the one or more legs. The at least one conductive pin may be configured to convey electrical signals between the first PCB and the second PCB when both of the first PCB and second PCB are connected to the PCB holder.

A further embodiment of the present invention provides a method of providing a horizontal printed circuit board (PCB) holder having a frame comprising one or more legs extending outwardly from the frame. Each of the one or more legs may include a passageway therein, and at least one conductive pin fixedly secured within the passageway of at least one of the one or more legs for connecting to at least a first PCB and a second PCB. The method may begin by determining at least one characteristic of at least one of the first PCB and the second PCB. The one or more legs of the PCB holder may be configured to correspond to the determined at least one characteristic of at least one of the first PCB and the second PCB. The first PCB may be connected to a first end of the one or more legs of the PCB holder. The second PCB may be connected to a second end of the one or more legs of the PCB holder. Electrical signals may be conveyed between the first PCB and the second PCB via the one or more conductive pins when the first PCB and the second PCB are connected to the PCB holder.

Numerous other objects, features, and advantages of the present invention will be readily apparent to those skilled in the art upon a reading of the following disclosure when taken in conjunction with the accompanying drawings.

DETAILED DESCRIPTION OF THE INVENTION

Figure 1:
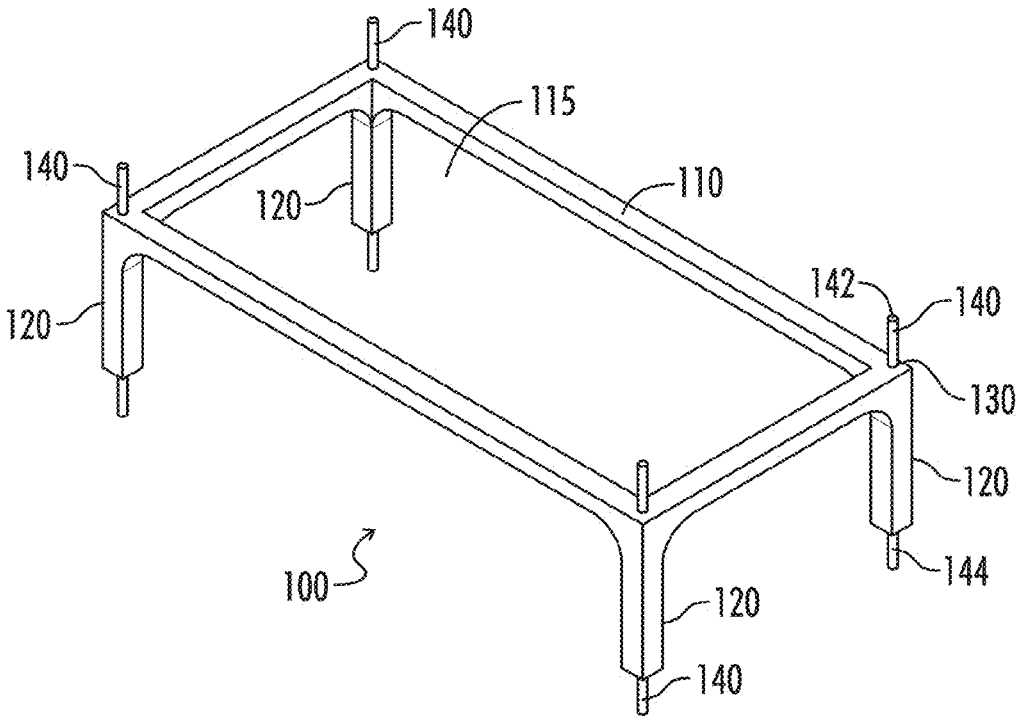
FIG. 1 is an elevated perspective view of a holder according to an exemplary embodiment of the present invention.

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

Referring generally to FIGS. 1-8, a frame positioned between a first printed circuit board (PCB) and a second PCB is provided in greater detail. Where the various figures may describe embodiments sharing various common elements and features with other embodiments, similar elements and features are given the same reference numerals and redundant description thereof may be omitted below.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims. The phrase "in one embodiment," as used herein does not necessarily refer to the same embodiment, although it may.

The term "circuit" means at least either a single component or a multiplicity of components, either active and/or passive, that are coupled together to provide a desired function. Terms such as "wire," "wiring," "line," "signal," "conductor," and "bus" may be used to refer to any known structure, construction, arrangement, technique, method and/or process for physically transferring a signal from one point in a circuit to another. Also, unless indicated otherwise from the context of its use herein, the terms "known," "fixed," "given," "certain" and "predetermined" generally refer to a value, quantity, parameter, constraint, condition, state, process, procedure, method, practice, or combination thereof that is, in theory, variable, but is typically set in advance and not varied thereafter when in use.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

Various embodiments of a holder 100 according to the present invention may be designed to be placed in contact with a first PCB and a second PCB, and to provide electrical connection between the first and second PCBs using conductive pins provided by the holder.

In one exemplary embodiment illustrated by FIG. 1, a holder 100 may include a frame 110 and one or more legs 120. A cavity 115 may be defined within an inner surface of the frame as illustrated by FIG. 1. Although illustrated as forming a rectangular shape, the frame 110 and cavity 115 each may take the form of a plurality of shapes, for example based upon a desired implementation, preferred heat dissipation or cooling structure, use a grounding and/or shielding plane, a desired PCB size, etc., without departing from the scope of the present invention.

The one or more legs 120 may be connected to the frame 110 at one or more openings 130. Each of the one or more openings 130 may have a pin 140 passing through a passageway corresponding to at least a portion of the opening 130. The frame 110 may be formed of a conductive and/or non-conductive material. For example, the frame 110 may be formed from a plastic material, a composite material, a metallic conductor, or any other material capable of providing structural rigidity and/or conductivity in accordance with the present invention. Pins 140 may be formed from at least one conductive material. For example, pins 140 may be a metallic pin, for example, made from a conductive metallic alloy, gold, copper, or any other conductive substance capable of conveying signals in accordance with the present invention.

In one embodiment, the opening 130 may extend through leg(s) 120. However, in an alternate embodiment, each leg 120 may include one or more openings 130 which extend into at least a portion of a leg 120 without passing fully through the leg 120. In this example, each leg may include one or more pins 140 connected to one or more opening(s) 130 of leg(s) 120. In embodiments having two or more pins 140 connected to an opening 130, the opening 130 may possess therein a connector and/or electrical conductor (not illustrated) configured to convey electrical signals and/or power between the two or more pins 140.

Each pin 140 may have a first end 142 and a second end 144 located at opposing ends of the pin 140. In one exemplary embodiment, the first end 142 may be associated with a first PCB (e.g., first PCB 210), while the second end 144 may be associated with a second PCB (e.g., second PCB 510). In one exemplary embodiment, each first end 142 and/or second end 144 may be associated with one or more first and second PCBs. For example, a single pin 140 may be configured to pass through one or more first or second PCBs and to provide electrical and/or mechanical connections to each connected first and/or second PCB.

Although illustrated as possessing four sets of legs 120, pins 140, and openings 130, any number of legs 120, pins 140, and/or openings 130 may be used to form a holder 100 within the spirit and scope of the present invention. For example, in one embodiment, a holder 100 may include four legs 120 having four openings 130 housed therein, while the pins 140 used may include only two pins 140. In another embodiment, four pins 140 may be used, but only one pin 140 may form electrical connection to a second PCB while all four pins 140 may be used to form electrical connections to a first PCB (e.g., first PCB 210 illustrated by FIG. 2).

Figure 2:
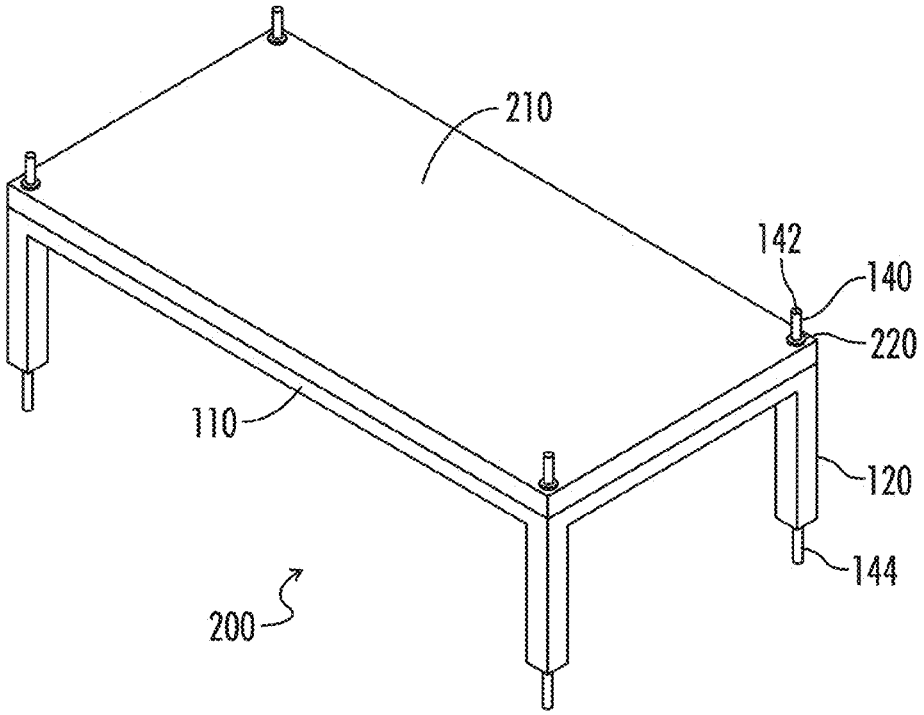
FIG. 2 is an elevated perspective view of a printed circuit board connected to a holder of FIG. 1 according to an exemplary embodiment.

FIG. 2 illustrates an assembly 200 that includes a first PCB 210 coupled to a holder 100. The first PCB 210 may be configured to be placed in contact with the holder 100 at the frame 110 of the holder 100. In one embodiment, at least a portion of the first PCB 210 may be configured to span at least a portion of the cavity 115 defined by frame 110. As described herein, the first PCB 210 may be configured in a plurality of ways. For example, the first PCB 210 may be configured to function as an electrical circuit (e.g., as a daughter card), to function as a shield or ground plane, and/or to function as one or more jumpers for a second PCB (e.g., second PCB 510). In one exemplary embodiment, the first PCB 210 may be configured to form one or more electrical and/or mechanical connections with the holder 100 using at least one pin 140. Although the embodiment illustrated at FIG. 2 provides four pins 140 associated with holder 100, it should be recognized that any number of pins 140 may be used for connecting the first PCB 210 and holder 100 without departing from the spirit and scope of the present invention.

The first PCB 210 may include a printed circuit board of a sufficient structural and functional configuration capable of interconnection and operation with a holder 100. For example, the first PCB 210 may include a printed circuit board having one or more functional components which may be interconnected to perform operation(s) in a desired manner. The first PCB 210 may further include one or more connectors 220 configured to receive at least a portion of a pin 140. For example, a connector 220 may be configured as an opening extending through the first PCB 210 which is configured to receive at least a portion of pin 140 (e.g., at a first end 142 as illustrated by FIG. 2). As used herein, a connector 220 may include, in one exemplary embodiment, a through hole or via. Connector 220 may be attached in an embodiment to the first PCB 210 by soldering, press-fit connection, or other connection means. In one embodiment, at least a portion of the connector 220 may include a conductive material capable of conveying one or more electrical signals. For example, in one exemplary embodiment, the conductor 220 may be configured to electrically and/or mechanically connect the first PCB 210 and holder 100 via at least one pin 140.

Figure 3:
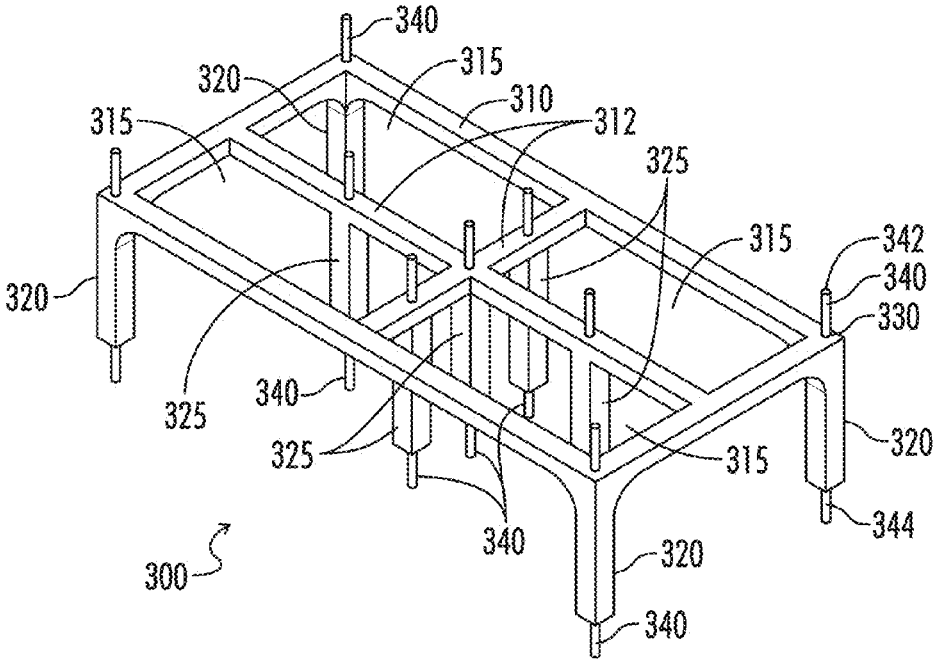
FIG. 3 is an elevated perspective view of a holder having a plurality of cross-members according to an exemplary embodiment of the present invention.

As illustrated, for example, by FIG. 3, each holder 300 may include a plurality of legs 320 extending outwardly from frame 310. The frame 310 may include at least one cross-member 312. Each cross-member 312 may have at least one inner leg 325. As used herein, leg(s) 320 and 325 may be structurally and functionally equivalent to legs 120 described above with reference to FIGS. 1 and 2. For example, each leg 320 and 325 may include at least one pin 340 at an opening 330 corresponding to at least one leg 320 or 325. The pins 340 may include a first end 342 and a second end 344 located at opposing ends of each pin 340. In one exemplary embodiment, the first end 342 and second end 342 may be associated with one or more first and second PCBs as previously described with reference to FIG. 1. By utilizing one or more cross-members 312, a holder 300 may provide increased electrical and/or mechanical connections between first and second PCBs. Cavities 315 may be defined between the frame 310 and cross-members 312, or may be defined in spaces between cross-members 312.

Figure 4:
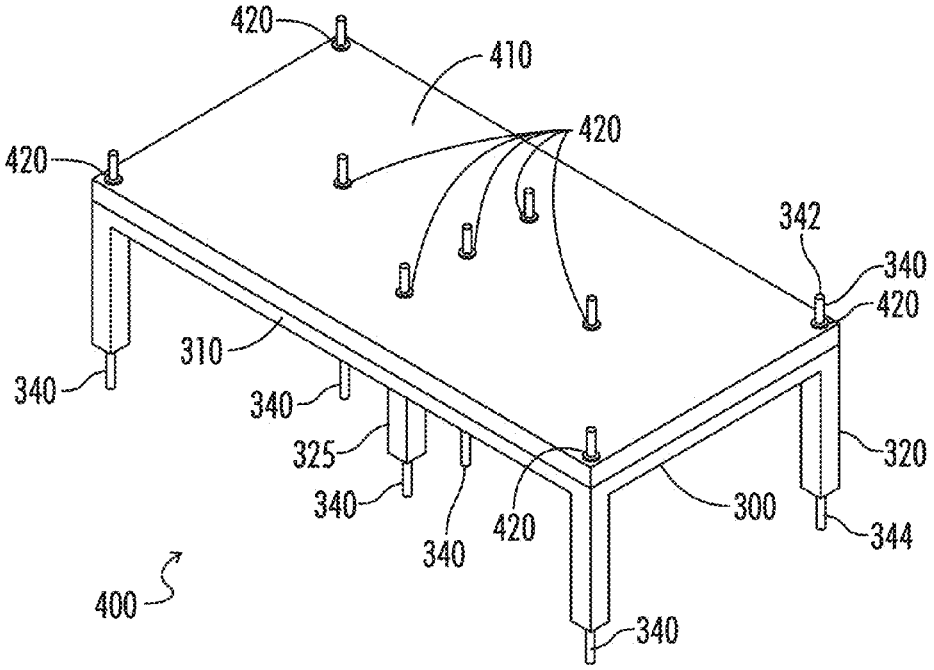
FIG. 4 is an elevated perspective view of a printed circuit board connected to a holder of FIG. 3 according to an exemplary embodiment.

FIG. 4 illustrates an exemplary embodiment having a combined PCB holder 400 having a holder 300 connected to a first PCB 410. The first PCB 410 may, in one embodiment, be configured to span at least a portion of a cavity 315 defined by frame 310 of holder 300. The first PCB 410 may be electrically and/or mechanically connected to the holder 300 via connection between the first PCB 410 and one or more pins 340. The first PCB 410 may be configured to form one or more electrical and/or mechanical connections with the holder 300 using at least one pin 340. Although the embodiment illustrated at FIG. 4 provides nine pins 340 associated with holder 300, it should be recognized that any number of pins 340 may be used for connecting the first PCB and holder 300 without departing from the spirit and scope of the present invention.

Although illustrated in FIG. 4 as having single board, the first PCB 410 may include one or more boards. In practice, the first PCB 410 may include one or more printed circuit boards logically or physically viewed as a single operable PCB. In one exemplary embodiment, each printed circuit board forming the first PCB 410 may be associated with a dedication function or may be dynamically configurable and/or replaceable according to a particular desired functionality or result.

The first PCB 410 may include one or more connectors 420 configured to receive at least a portion of a pin 340. For example, a connector 420 may be configured as an opening extending through the first PCB 410 which is configured to receive at least a portion of pin 340 (e.g., at a first end 142/342 as illustrated by FIGS. 2 and 4). In one embodiment, at least a portion of the connector 420 may include a conductive material capable of conveying one or more electrical signals. For example, in one exemplary embodiment, the conductor 420 may be configured to electrically and mechanically connect the first PCB 410 and holder 300. Similar to connectors 220, each connector 420 may include a through hole or connector in one embodiment, and may be connected to the first PCB 410 by means of solder, press-fit connection, or other connection means.

Figure 5A:
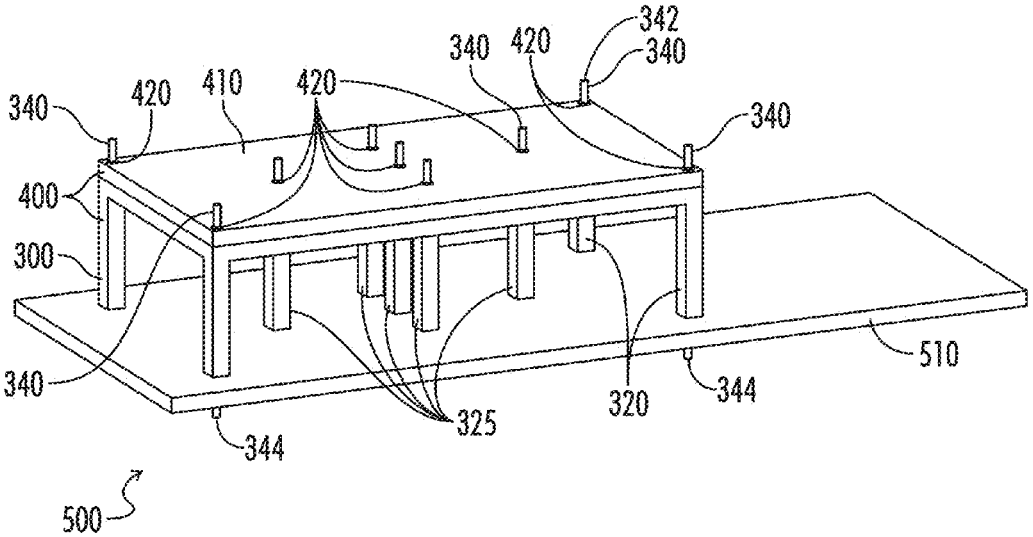
FIGS. 5A-B respectively illustrate a raised perspective view and a side perspective view of a PCB holder assembly according to an exemplary embodiment of the present invention.
Figure 5B:
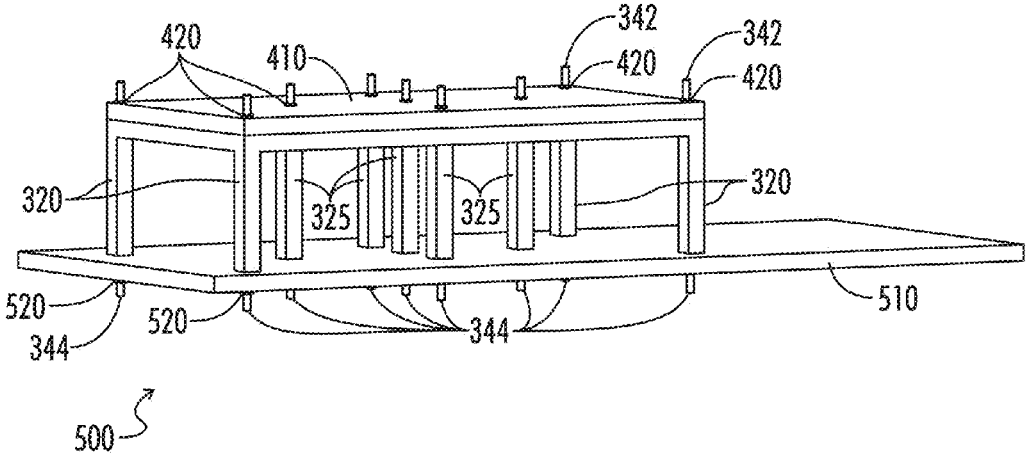

FIGS. 5A-B illustrate perspective views of a PCB holder assembly 500 according to an exemplary embodiment of the present invention. As illustrated in FIG. 5A, a first PCB 410 may be connected to a holder 300 as described above with reference to FIGS. 3-4. One or more pins 340 may be used to electrically and/or mechanically connect the first PCB 410 and holder 300 to form a combined holder 400. For example, one or more first ends 342 of at least one pin 340 may electrically and/or mechanically couple the first PCB 410 and holder 300 at one or more connectors 420. One or more second PCBs 510 may be configured to mechanically and electrically couple to the holder 300 using one or more second ends 344 of one or more pins 340.

As illustrated at FIG. 5B, each second end 344 may connect to a second PCB 510 at one or more connectors 520. The connector(s) 520 may be configured in a manner similar to that described above with reference to connector(s) 420. The first PCB 410 may include one or more connectors 420 configured to receive at least a portion of a pin 340. For example, a connector 420 may be configured as an opening extending through the first PCB 410 which is configured to receive at least a portion of pin 340 (e.g., at a first end 142/342 as illustrated and described with reference to FIGS. 2 and 4). Specifically, in one embodiment, at least a portion of a connector 520 may include a conductive material capable of conveying one or more electrical signals. For example, in one exemplary embodiment, the conductor 520 may be configured to electrically and/or mechanically connect the second PCB 510 and holder 300. Although the second PCB 510 is illustrated in FIGS. 5A-B as being larger than the first PCB 410, it should be recognized that the second PCB 510 may be smaller, larger, or the same size as the first PCB 410 without departing from the spirit and the scope of the present invention.

The PCB holder assembly 500 may be configured to convey electrical signals and/or power between the first PCB 410 and second PCB 510 by means of one or more pins 340. In one exemplary embodiment, the PCB holder assembly 500 may be configured to electrically interconnect a larger printed circuit board such as a motherboard and a smaller printed circuit board such as a daughter card, in a parallel configuration. For example, in one exemplary embodiment, the first PCB 410 may include a daughter card and the second PCB may include a motherboard configured to cooperatively function with one another using electrical connections provided by one or more pins 340. Alternatively or in addition to an association between a first PCB 410 and second PCB 510, a plurality of first PCB 410 and/or second PCB 510 may be connected using one or more pins 140/340 of a holder 100/300 or a plurality of holders 100/300 without departing from the scope of the present invention.

As illustrated by FIGS. 5A-B, in one exemplary embodiment, a relationship between the holder 300, first PCB 410, and second PCB 510 may be such that the first PCB 410 and second PCB 510 are positioned substantially horizontally (e.g., parallel) relative to one another when both are connected to a holder 300. Although the second PCB 510 is illustrated as a single printed circuit board in FIGS. 5A-B, it should be understood that the second PCB 510 may, in one exemplary embodiment, include one or more printed circuit boards viewed physically or logically as a single PCB. In this example, two or more printed circuit boards forming the second PCB 510 may be connected to one or more pins 340 of holder 300. Furthermore, the shape, size, and configuration of the first PCB 410 and second PCB 510 are not exclusive to the relative dimensions provided in FIGS. 5A-B.

Figure 6:
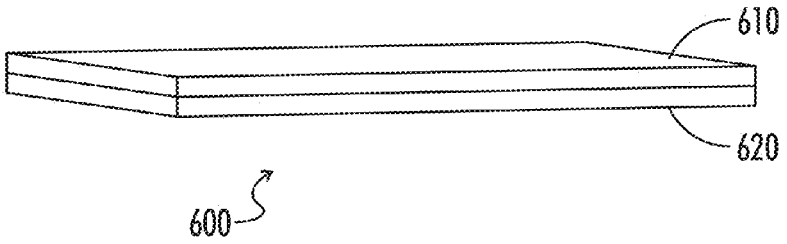
FIG. 6 is a side perspective view of a printed circuit board according to an exemplary embodiment.

FIG. 6 illustrates a first PCB 600 according to an exemplary embodiment of the present invention. As illustrated by FIG. 6, a first PCB 600 may include a substrate 610 and a layer 620. The substrate 610 may include, for example, a conventional printed circuit board comprising one or more circuit elements. The layer 620 may be configured to be placed in contact with at least a portion of a frame 110/310 of a holder 100/300. The layer 620 may be used to provide various beneficial effects with respect to the first PCB 600, a holder 100/300, a second PCB 510, or any combination thereof. In various embodiments, the layer 620 may be or include a shielding layer, a grounding layer, a spacer, or any other component layer providing a beneficial effect to at least one component of a PCB holder assembly (e.g., a PCB holder assembly 500). For example, in one exemplary embodiment, the layer 620 may provide shielding between the first PCB 600 and an external component (e.g., a second PCB 510). Alternatively or in addition to providing shielding, the layer 620 may include a grounding layer for use with the first PCB 600 or a component associated with the first PCB 600 (e.g., a pin 140/340, a second PCB 510, etc.).

Figure 7:
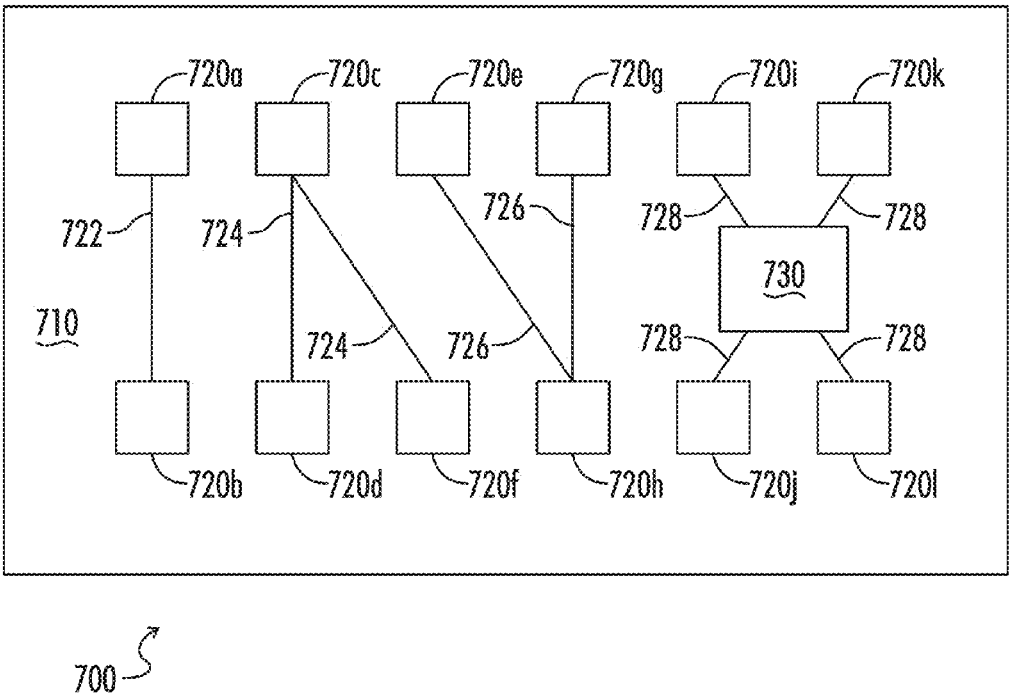
FIG. 7 is a schematic view of a printed circuit board according to an exemplary embodiment.

FIG. 7 illustrates a schematic illustrating an exemplary embodiment of a printed circuit board according to various aspects of the present invention. As illustrated at FIG. 7, a PCB 700 may include a substrate 710, one or more connectors 720*a*-1, and component(s) 730. Substrate 710 may include a traditional printed circuit board material in one embodiment. The substrate 710 may include at least one connector 720 configured to transmit and/or receive electrical signals. Each connector 720 may further be configured to electrically and/or mechanically connect the PCB 700 to an external element. One or more of connectors 720*a-l* may be associated with a circuit land and/or run configuration between the PCB 700 and an external PCB (e.g., a second PCB 510). For example, each connector 720 may be spatially configured to correspond to a circuit land or run configuration associated with an external PCB, and/or may be placed to correspond to a circuit land or run configuration of the PCB 700 itself.

One or more connectors 720 may be connected to one another to form a jumper in an exemplary embodiment. For example, as illustrated at FIG. 7, a connector 720*a* may be linked to connector 720*b* by means of a conductor 722. A connector 720 may connected to a plurality of other connectors 720 in one embodiment. For example, FIG. 7 illustrates connector 720*c* connected to connectors 720*d* and 720*f* via conductor(s) 724. Similarly, connectors 720*e* and 720*g* may be connected to connector 720*h* via conductor(s) 726. Connectors 720 may permit communications with one or more component(s) 730 of PCB 700. For example, FIG. 7 illustrates connectors 720*i-l* being connected to component(s) 730 of PCB 700 via conductor(s) 728. Each of conductors 722, 724, 726, and 728 may include a material capable of conveying electrical signaling and/or power. For example, in one exemplary embodiment, the conductors 722, 724, 726, and 728 may include one or more metallic wire, conductive strip, or any other material capable of conveying electrical signals within the scope of the present invention.

Figure 8:
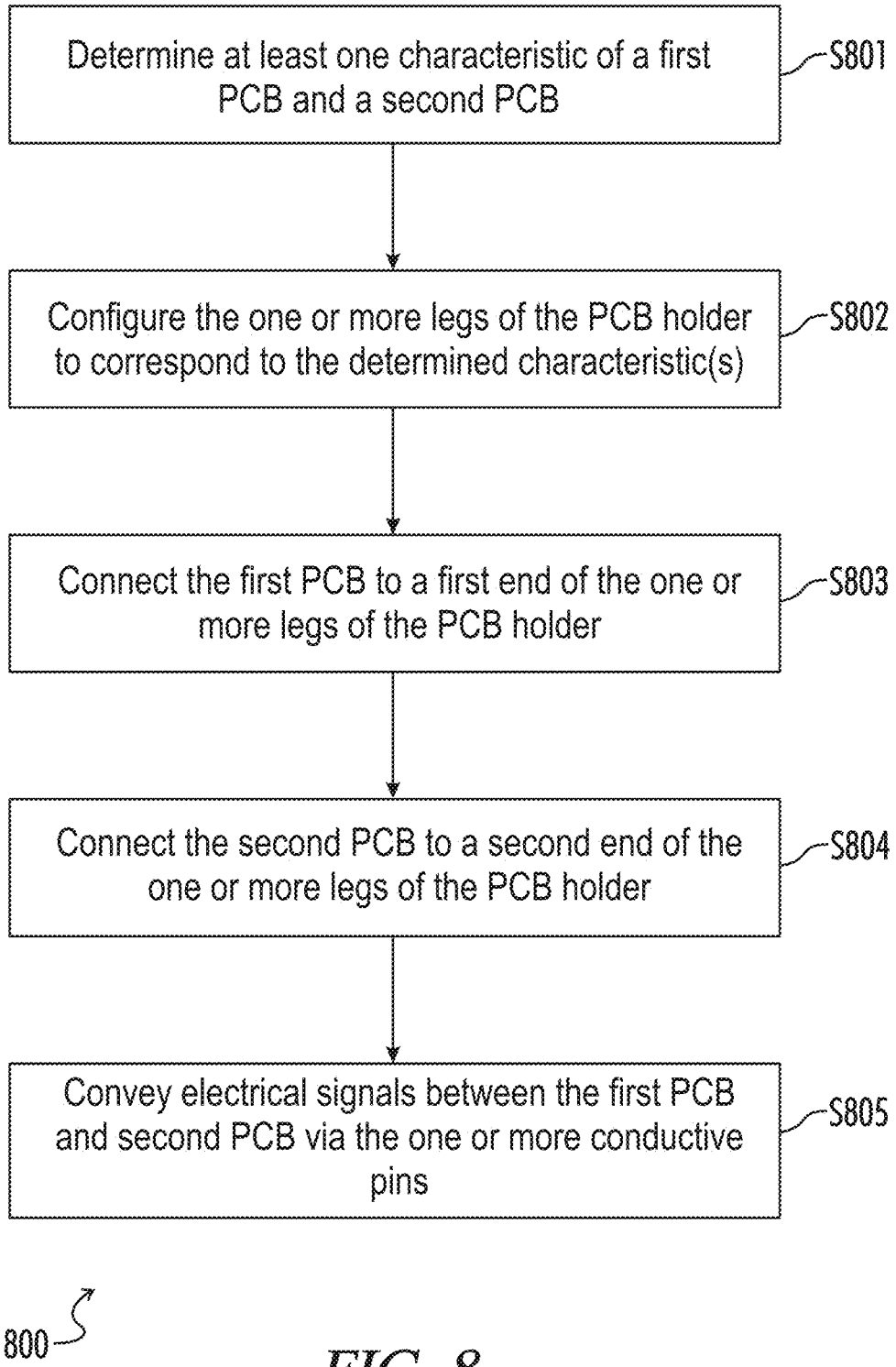
FIG. 8 is a flowchart illustrating a method of providing a horizontal printed circuit board (PCB) holder for connecting to at least a first PCB and a second PCB according to an exemplary embodiment of the present invention

FIG. 8 provides a flowchart illustrating a method of providing a horizontal printed circuit board (PCB) holder for connecting to at least a first PCB and a second PCB according to an exemplary embodiment. Each of the PCB holder, the first PCB, and the second PCB described in FIG. 8 may correspond to their respective previous descriptions herein with reference to FIGS. 1-7. The method 800 begins at step S801 where at least one characteristic of a first PCB and/or a second PCB is determined. One or more legs of the PCB holder may be determined and/or configured to correspond to the determined characteristic(s) at step S802. The first PCB may be connected to a first end of one or more legs of the PCB holder at step S803. At step S804, the second PCB may be connected to a second end of the one or more legs of the PCB holder. The method 800 may conclude by conveying electrical signals between the first PCB and second PCB via the one or more conductive pins.

As is apparent from the previous invention, the shape, size, physical, and logical configurations of one or more PCBs and holder(s) may be determined, modified, adapted, and/or otherwise configured to meet one or more specific desired parameter(s). For example, a holder 100/300 and/or first PCB 210/410 may be designed or otherwise configured to correspond to a shape, pin, jumper, shielding, grounding, or other configuration associated with a printed circuit board (e.g., a second PCB 510). Similarly, a configuration of a second PCB (e.g., second PCB 510) may be determined based upon a characteristic of a holder 100/300 and/or first PCB 210/410. By doing so, the present invention provides for decreased cost relative to conventional PCB connectors, while further providing for reduced size and complexity associated with conventional PCB designs and connectors.

The previous detailed description has been provided for the purposes of illustration and description. Thus, although there have been described particular embodiments of a new and useful invention, it is not intended that such references be construed as limitations upon the scope of this invention except as set forth in the following claims.

What is claimed is:

1. A horizontal printed circuit board (PCB) holder for connection to a first PCB and a second PCB, the PCB holder comprising:

a frame having one or more legs extending outwardly from the frame, each of the one or more legs comprising a passageway therein; and at least one conductive pin fixedly secured within the passageway of at least one of the one or more legs, wherein the at least one conductive pin is configured to convey electrical signals between the first PCB and the second PCB when both of the first PCB and second PCB are connected to the PCB holder.

2. The PCB holder of claim 1, wherein at least one of a size, a shape, a location of at least one of the one or more legs, and a location of at least one conductive pin of the PCB holder is configured to correspond to a characteristic of at least one of the first PCB and the second PCB.

3. The PCB holder of claim 1, wherein the at least one conductive pin includes a first end and a second end, and wherein the first PCB is configured to form an electrical connection with the first end of the at least one conductive pin and the second PCB is configured to form an electrical connection with the second end of the at least one conductive pin when the first PCB and the second PCB are connected to the PCB holder.

4. The PCB holder of claim 1, wherein a location of at least one conductive pin of the PCB holder is configured to correspond to a characteristic of at least one of the first PCB and the second PCB.

5. The PCB holder of claim 4, wherein the at least one conductive pin comprises a plurality of conductive pins and wherein the characteristic is a number of the conductive pins corresponding to a set of electrical connections associated with at least one of the first PCB and the second PCB.

6. The PCB holder of claim 4, wherein the characteristic is a size or a shape of at least one of the first PCB and the second PCB.

7. The PCB holder of claim 1, wherein the PCB holder further comprises:

a shielding plane associated with the first PCB, wherein at least a portion of the shielding plane is configured to be received by the PCB holder at a surface of the frame opposite to the second PCB.

8. The PCB holder of claim 1, wherein the first PCB comprises a daughter board and the second PCB comprises a motherboard having a size greater than the first PCB.

9. The PCB holder of claim 1, wherein the PCB holder further comprises:

at least one cross-member extending between opposing inner surfaces of the frame, the at least one cross-member comprising at least one inner leg having a passageway therein, and at least one conductive pin fixedly secured within the passageway of the at least one inner leg.

10. The PCB holder of claim 1, wherein the at least one conductive pin of the PCB holder is configured to connect to a grounding plane associated with the first PCB.

11. The PCB holder of claim 1, wherein the at least one conductive pin of the PCB holder is configured to connect to the first PCB operating as one or more jumpers corresponding to the second PCB when the first PCB and the second PCB are connected to the PCB holder.

12. A horizontal printed circuit board (PCB) holder assembly comprising:

a first PCB;

a second PCB; and a PCB holder comprising:

a frame having one or more legs extending outwardly from the frame, each of the one or more legs comprising a passageway therein, and at least one conductive pin fixedly secured within the passageway of at least one of the one or more legs, wherein the at least one conductive pin is configured to convey electrical signals between the first PCB and the second PCB when both of the first PCB and second PCB are connected to the PCB holder.

13. The PCB holder assembly of claim 12, wherein a location of at least one conductive pin of the PCB holder is configured to correspond to at least one of a size, a shape, and a number of electrical connections associated with one or more of the first PCB and the second PCB.

14. The PCB holder assembly of claim 12, wherein the first PCB comprises a shielding plane, and wherein at least a portion of the shielding plane is configured to be received by the PCB holder at a surface of the frame opposite to the second PCB.

15. The PCB holder assembly of claim 12, wherein the first PCB comprises a daughter board and the second PCB comprises a motherboard having a size greater than the first PCB.

16. The PCB holder assembly of claim 12, wherein the first PCB comprises a grounding plane, and wherein at least one conductive pin of the PCB holder is configured to connect to the grounding plane of the first PCB.

17. The PCB holder assembly of claim 12, wherein the first PCB is configured to operate as one or more jumpers corresponding to the second PCB when the first PCB and the second PCB are connected to the PCB holder.

18. The PCB holder assembly of claim 12, wherein the first PCB comprises at least one first connector configured to receive a first end of the at least one conductive pin, and wherein the second PCB comprises at least one second connector configured to receive a second end of the at least one conductive pin, wherein electrical signals may be exchanged between the first PCB and the second PCB via the first and second ends of the at least one conductive pin.

19. A method of providing a horizontal printed circuit board (PCB) holder having a frame comprising one or more legs extending outwardly from the frame, each of the one or more legs comprising a passageway therein, and at least one conductive pin fixedly secured within the passageway of at least one of the one or more legs for connecting to at least a first PCB and a second PCB, the method comprising:

determining at least one characteristic of at least one of the first PCB and the second PCB;

configuring the at least one conductive pin associated with one or more legs of the PCB holder to correspond to the determined at least one characteristic of at least one of the first PCB and the second PCB;

connecting the first PCB to a first end of the one or more legs of the PCB holder;

connecting the second PCB to a second end of the one or more legs of the PCB holder; and conveying electrical signals between the first PCB and the second PCB via the at least one conductive pin when the first PCB and the second PCB are connected to the PCB holder.

20. The method of claim 19, wherein the first PCB comprises a daughter board and the second PCB comprises a motherboard, and wherein the first PCB operates as at least one of an electrical circuit connected to the second PCB, a shielding or grounding plane connected to the second PCB, and one or more jumpers connected to the second PCB.

* * * * *